US007213407B2

(12) United States Patent
Hu

(10) Patent No.: US 7,213,407 B2
(45) Date of Patent: May 8, 2007

(54) WIDE TEMPERATURE RANGE HEAT PUMP

(76) Inventor: Lung Tan Hu, 25755 48th Ave, Aldergrove (CA) V4W 1J6

( * ) Notice: Subject to any disclaimer, the term of this patent is extended or adjusted under 35 U.S.C. 154(b) by 269 days.

(21) Appl. No.: 11/103,221

(22) Filed: Apr. 12, 2005

(65) Prior Publication Data

US 2006/0225451 A1 Oct. 12, 2006

(51) Int. Cl.
*F25B 41/00* (2006.01)

(52) U.S. Cl. ..... 62/324.5; 62/324.1

(58) Field of Classification Search ..... 62/272, 62/324.1, 324.2, 324.5, 515
See application file for complete search history.

(56) References Cited

U.S. PATENT DOCUMENTS 3,466,888 A * 9/1969 Kyle ..... 62/156
4,373,350 A * 2/1983 Noland ..... 62/156

* cited by examiner

*Primary Examiner*—Melvin Jones

(57) ABSTRACT

The present invention provides an air-condition heat pump capable of defrosting and air-conditioning at same time. The present invention utilizes at least two evaporators, which harvest the energy from one working evaporator to provide energy for defrost operation of another evaporator, thus the air-condition heat pump can defrost without additional energy. Under low temperature working condition, the present invention utilizes a suction pressure boost to increase efficiency.

12 Claims, 4 Drawing Sheets

WIDE TEMPERATURE RANGE HEAT PUMP

FIELD OF THE INVENTION

The present invention relates to a wide-range air-condition heat pump, more particularly to a wide-range air-condition heat pump capable of uninterrupted operation while defrosting. The present invention can be applied on residential, agriculture ,and industrial purposes.

BACKGROUND OF THE INVENTION

Current available heat pump has low efficiency under low temperature working condition. The current defrosting methods such as electrical defrost system and reverse-circulation defrost system require the heat pump to stop operation while defrosting. Therefore, it is the primary objective of the present invention to provide an air-condition heat pump capable of uninterrupted operation during defrosting.

In general, current heat pump has very limited range of working temperatures due to operation efficiency. However, outdoor temperature may vary from negative 40 degree Celsius to 10 degree Celsius, therefore it is another objective of the present invention to provide a wide range air-condition heat pump capable of operating under wide range of working environment temperature at high efficiency.

SUMMARY OF THE INVENTION

1. It is a primary object of the present invention to provide an air-condition heat pump capable of uninterrupted operation while defrosting.

2. It is a secondary object of the present invention to provide a wide range air-condition heat pump capable of operating under various range of temperature.

3. It is yet another object of the present invention to provide an air-condition heat pump capable of defrosting without additional energy.

DESCRIPTION OF THE PREFERRED EMBODIMENTS

Figure 1:
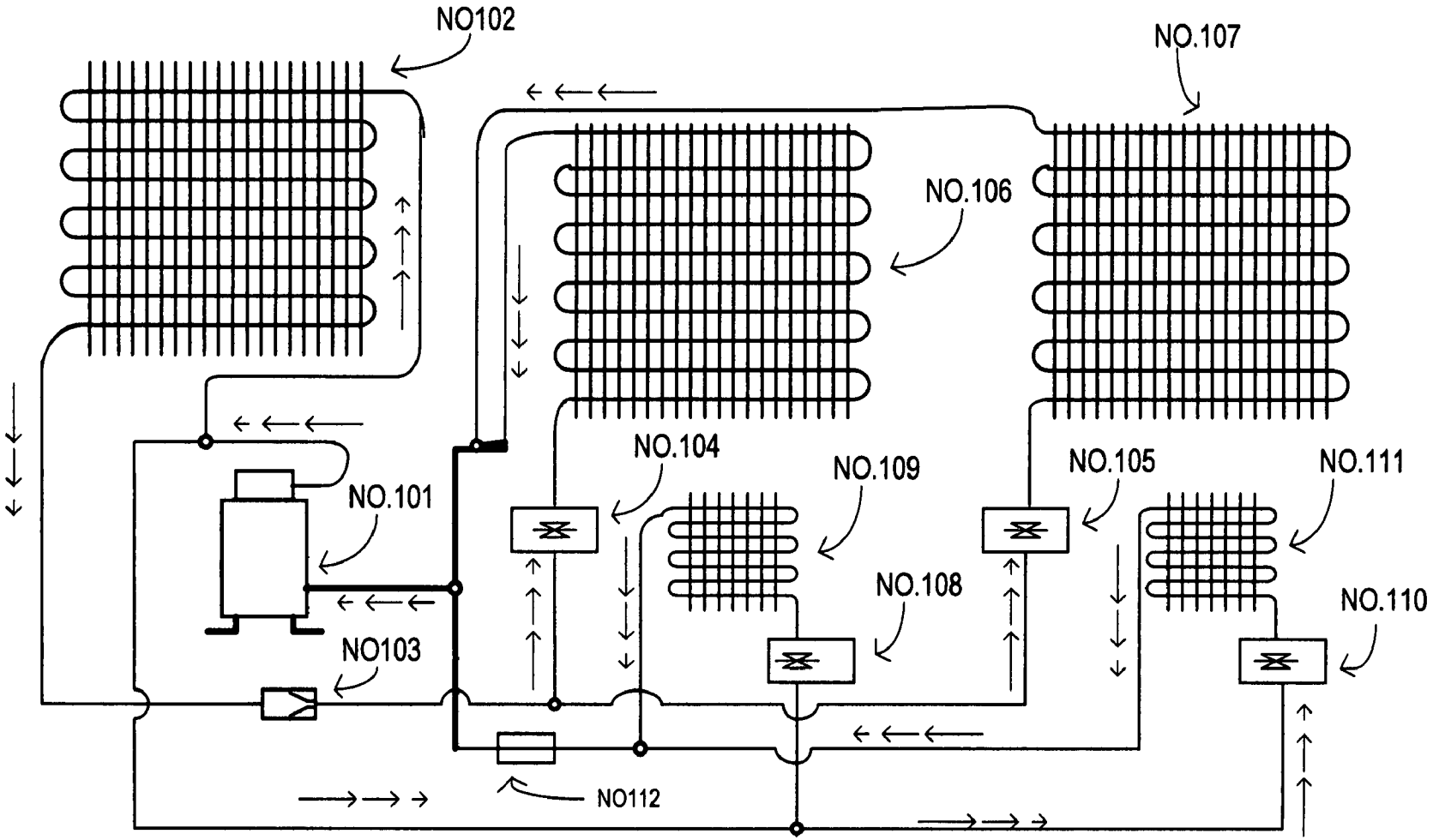
FIG. 1 is a illustrative diagram of the present invention with two defrost condensers.

Referring to FIG. 1, when the air-condition heat pump starts operating, compressor 101 pumps refrigerant into condenser 102. After refrigerant has condensed, refrigerant flows through expansion valve 103 to solenoid valve 104 and solenoid valve 105. At this time, both solenoid valve 104 and solenoid valve 105 are open. The refrigerant flows through solenoid valve 104 and solenoid valve 105 to evaporator 106 and evaporator 107 respectively. Then refrigerant in evaporator 106 and evaporator 107 return to compressor 101. The pressure regulator 112 is used to control the refrigerant pressure of defrost condenser 109 and defrost condenser 111.

During defrosting process of evaporator 106, solenoid valve 104 is closed and solenoid 108 is open. The compressor sends heated refrigerant to defrost condenser 109 through solenoid valve 108. Then heat from the defrost condenser 109 is used to heat up evaporator 106 by heat conducting means such as fan or direct contact.

During defrosting process of evaporator 107, solenoid valve 105 is closed and solenoid 110 is open. The compressor sends heated refrigerant to defrost condenser 111 through solenoid valve 110. Then heat from the defrost condenser is 111 used to heat up evaporator 107 by heat conducting means such as fan or direct contact.

Figure 2:
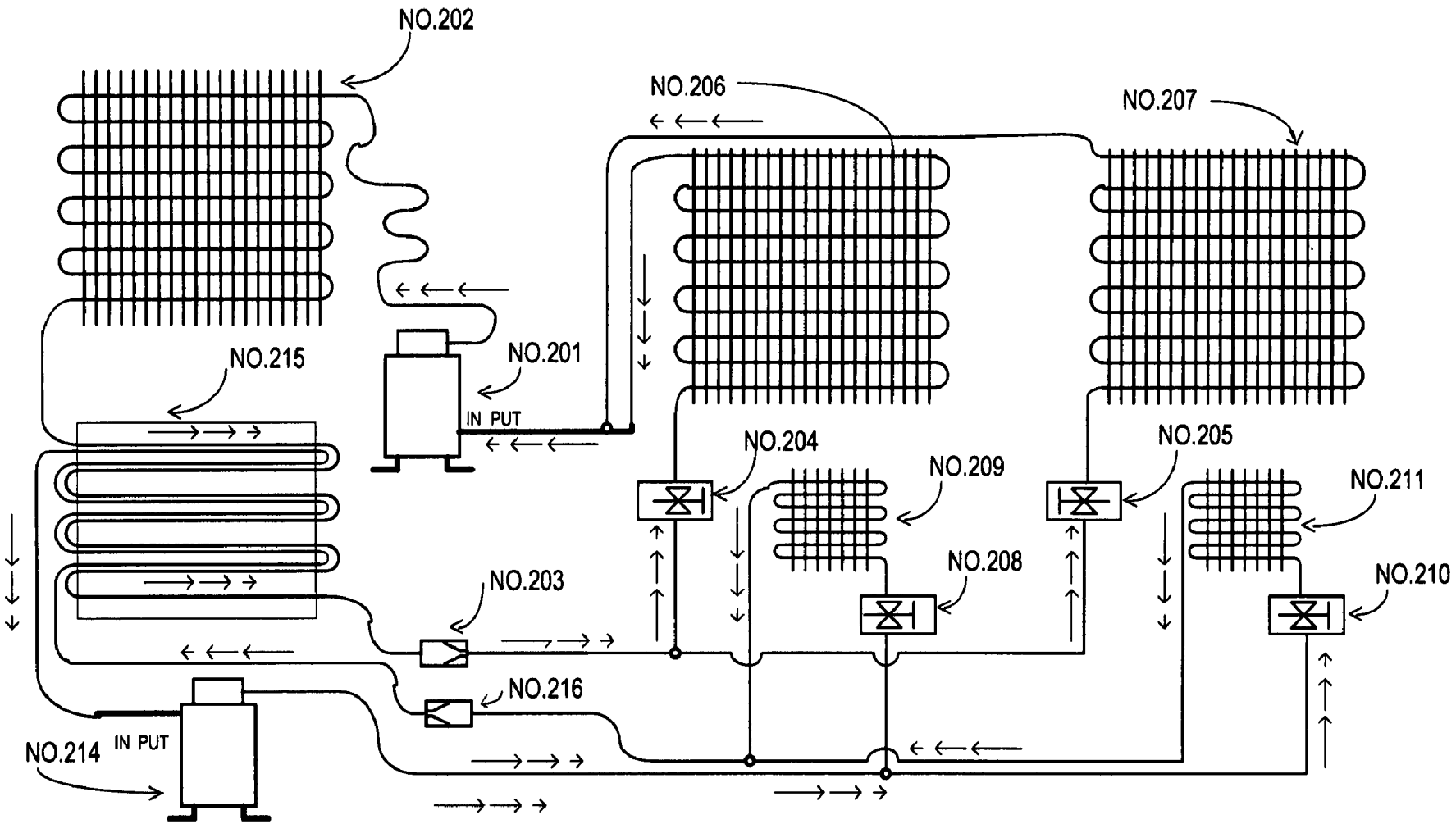
FIG. 2 is illustrative diagram of the present invention with secondary compressor and two defrost condenser.

Referring to FIG. 2, an air-condition heat pump with secondary compressor is provided. When the primary heat pump starts operating, compressor 201 pumps refrigerant into condenser 202. After refrigerant has condensed, refrigerant flows through expansion valve 203 to solenoid valve 204 and solenoid valve 205. At this time, both solenoid valve 204 and solenoid valve 205 are open. The refrigerant flows through solenoid valve 204 and solenoid valve 205 to evaporator 206 and evaporator 207 respectively. Then refrigerant in evaporator 206 and evaporator 207 return to compressor 201.

During defrosting process of evaporator 206, solenoid valve 204 is closed. ,solenoid valve 208 is open to provide passage for refrigerant. Then secondary compressor 214 starts operating and sending heated refrigerant to defrost condenser 209 through solenoid valve 208. Then the heat from defrost condenser 209 is used to heat up evaporator 206 by heat conducting means such as fan or direct contact. The refrigerant in defrost condenser 209 flows through expansion valve 216. Then the refrigerant from expansion valve 216 enters heat exchanger 215 to absorb heat from the refrigerant in primary heat pump. Then the refrigerant returns to secondary compressor 214.

During defrosting process of evaporator 207, solenoid valve 205 is closed. Solenoid valve 210 is open to provide passage for refrigerant. Then secondary compressor 214 starts operating and sending heated refrigerant to defrost condenser 211 through solenoid valve 210. Then the heat from defrost condenser 211 is used to heat up evaporator 207 by heat conducting means such as fan or direct contact. The refrigerant in defrost condenser 211 flows through expansion valve 216. Then the refrigerant from expansion valve 216 enters heat exchanger 215 to absorb heat from the refrigerant in primary heat pump. Then the refrigerant returns to secondary compressor 214.

Figure 3:
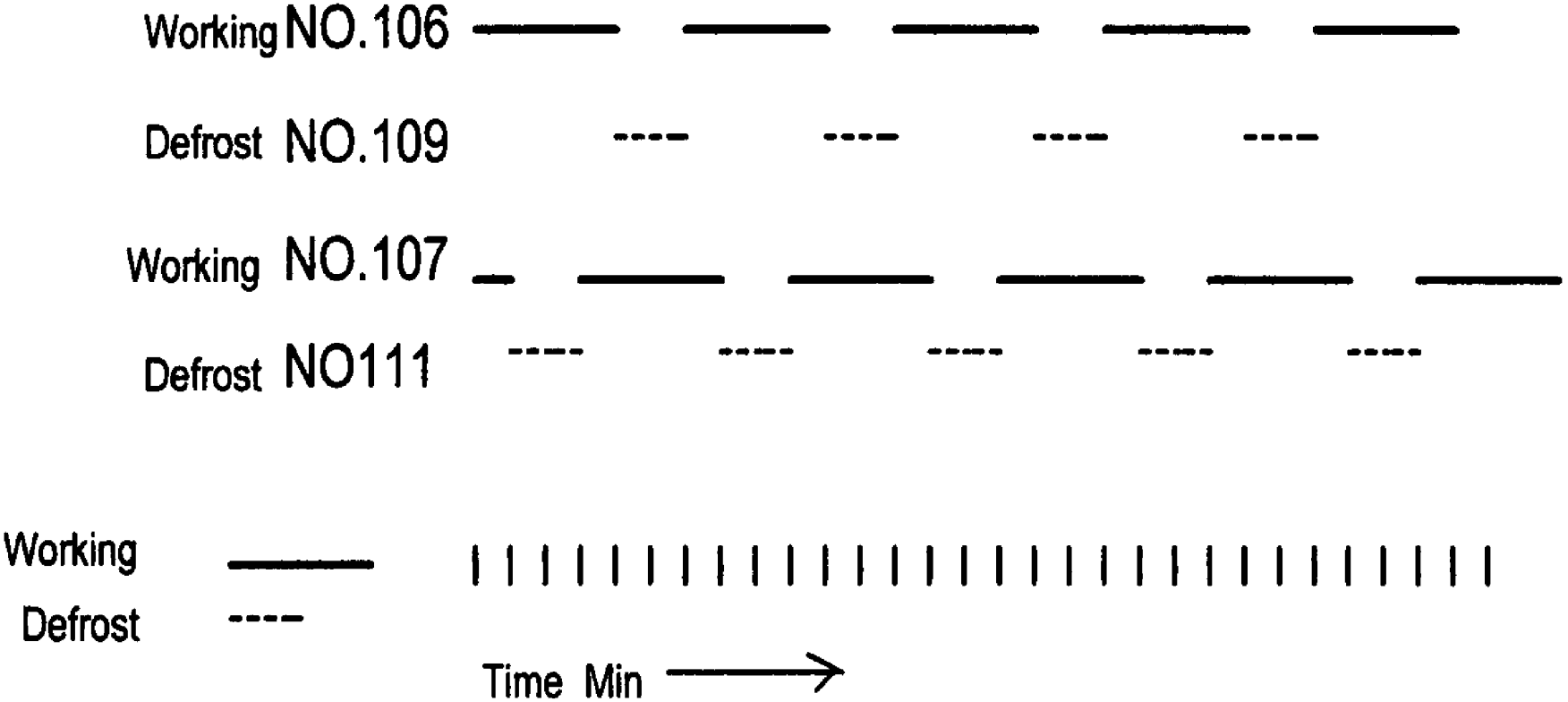
FIG. 3 is an exemplary defrosting procedure of the present invention.

FIG. 3 is an exemplary working procedure table of the present invention as explained in FIG. 1 when defrosting is required. When evaporator 107 requires defrosting, evaporator 107 stops operating, and evaporator 106 continues operating to provide heat energy that defrost condenser 111 required to defrost evaporator 107. After a preset time has reached or if sensor (not shown) has detected no further defrosting is necessary, defrost condenser 111 stops defrosting and evaporator 107 starts working. When evaporator 106 requires defrosting, evaporator 106 stops operating, and evaporator 107 continues operating to provide heat energy that defrost condenser 109 required to defrost evaporator 106. After a preset time has reached or if sensor has detected no further defrosting is necessary, defrost condenser 109 stops defrosting and evaporator 106 starts working. When both of evaporator 106 and evaporator 107 can operate without frosting, both of them can uninterruptedly operate.

Under severe working condition, the working procedure could follow the exemplary working procedure table as in FIG. 3. Each of the evaporator operates for 20 minutes and defrosts for 10 minutes. Same concept and working procedure can be applied on all other embodiments of the present invention.

Figure 4:
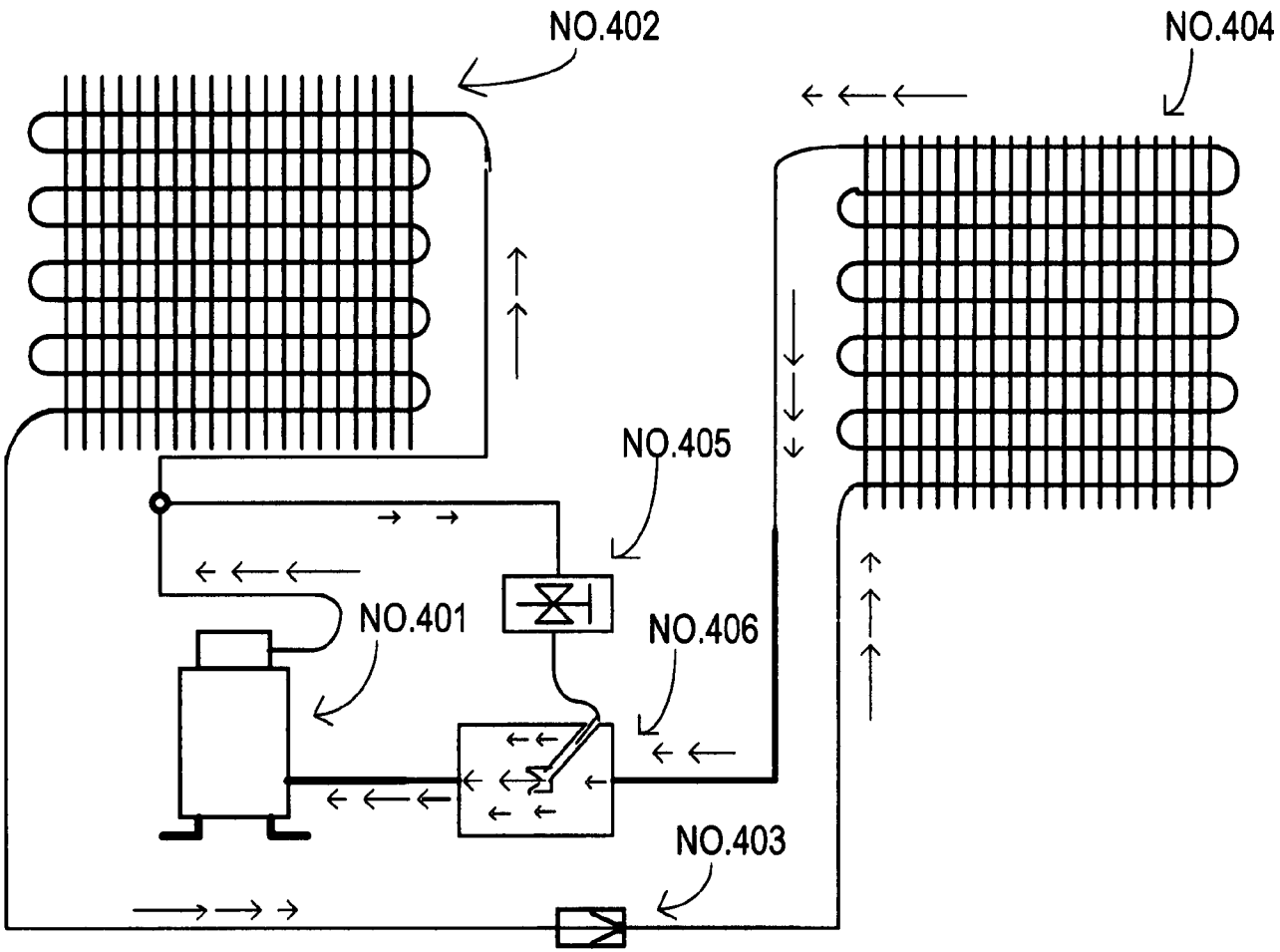
FIG. 4 is an illustrative diagram of the present invention with wide temperature range working capability.

FIG. 4 shows an illustrative diagram of a wide range air-condition heat pump. When the wide range air-condition heat pump starts operating in high temperature range working environment (approximately 0 degree to 10 degree° C.), compressor 401 pumps refrigerant into condenser 402. After refrigerant has condensed, refrigerant flows through expansion valve 403 to evaporator 404. Then refrigerant in evaporator 404 flows to pressure boosting jet pump 406. At this time, solenoid valve 405 is closed, and the refrigerant flows through pressure boosting jet pump 406 to compressor 401 without being boosted in pressure. When the wide range air-condition heat pump operates in low temperature range working environment (below 0 degree ° C.), solenoid valve 405 is open and the pressure of the refrigerant is boosted by pressure boosting jet pump 406, then the intake pressure of compressor 401 is higher than the pressure within evaporator 404, thus the working efficiency is increased and the system can adapt to low temperature range working environment. Further embodiments of the present invention could include multiple set of jet pumps for operation under severe working environment. When the present invention operates with multiple set of pressure boosting jet pumps, a by-pass passage and one-way valve could used to control the intake pressure of compressor.

What is claimed:

1. An air condition heat pump comprising:

a) one compressor for pumping the refrigerant into a main condenser;

b) at least two evaporators connecting with said main condenser;

c) an expansion valve for regulating the pressure between said main condenser and said two evaporators;

d) at least one control valve associated with each evaporator for stopping the refrigerant flowing during defrosting process;

e) Defrosting means connecting to said compressor and utilizing the heat energy from said evaporators for defrosting;

Wherein during the defrosting process, the air condition heat pump is capable of uninterrupted operation by turning off one evaporator and redirect the energy from the operation of another evaporator to said defrosting means; after the defrosting process of one evaporator is completed, another evaporator starts defrosting with same method.

2. An air condition heat pumps comprising:

a) One compressor 101 for pumping the refrigerant into a main condenser 102;

b) At least two evaporators 106 107 following said main condenser 102;

c) An expansion valve 103 for regulating the pressure drop between said main condenser 102 and said two evaporators 106 107;

d) One solenoid valve 104 associated with said evaporator 106 for stopping the flow of the refrigerant during defrosting process of said evaporator 106;

e) One solenoid valve 105 associated with said evaporator 107 for stopping the flow of the refrigerant during defrosting process of said evaporator 107;

f) One defrosts condenser 109 connecting to the discharge port of said compressor 101;

g) One solenoid valve 108 for admitting the refrigerant flow into said defrost condenser 109 during the defrosting process of said evaporator 106;

i) one defrost condenser 111 connecting to the discharge port of said compressor 101;

j) one solenoid valve 110 for admitting the refrigerant flow into said defrost condenser 111 during the defrosting process of said evaporator 107;

k) at least one pressure regulator 112 for controlling the refrigerant pressure between said two defrost condensers 109 111 and the suction port of said compressor 101;

l) heat transferring means for said two defrost condenser 109 111 transferring the heat onto said two evaporator 106 107 respectively during defrosting process;

wherein when the defrosting process is not necessary, both said solenoid valve 108 and solenoid valve 110 remain closed;

wherein during the defrosting process of said evaporator 106, the air condition heat pump is capable of uninterrupted operation by turning off said evaporator 106 with said solenoid valve 104, said solenoid valve 108 is open and said evaporator 107 remains operating to provide the heat energy for said defrost condenser 109 to defrost said evaporator 106 with said heat transferring means; wherein during the defrosting process of said evaporator 107, the air condition heat pump is capable of uninterrupted operation by turning off said evaporator 107 with said solenoid valve 105, said solenoid valve 110 is open and said evaporator 106 remains operating to provide the heat energy for said defrost condenser 111 to defrost said evaporator 107 with said heat transferring means.

3. An air condition heat pump, as defined in claim 2, further comprises sensor means for detecting frosting condition of said evaporator 106 and evaporator 107.

4. An air condition heat pump, as defined in claim 2, wherein said heat transferring means is a fan.

5. An wide-temperature-range air condition heat pump comprising:

a) one compressor 401 for pumping the refrigerant into a condenser 402;

b) at least one evaporator 404 connecting with the output of said condenser 402;

c) an expansion valve 403 for controlling the pressure drop between said main condenser 402 and said evaporators 404;

d) a pressure boosting jet pump 406 connecting the output of said evaporator 404 and the suction port of said compressor 402 for boosting the intake pressure of said compressor 402;

e) the high pressure intake port of said pressure boosting jet pump 406 connecting to discharge port of said compressor 401, the low pressure intake port of said pressure boosting jet pump 406 connecting to said evaporator 404:

f) a control valve 405 associated with the high pressure intake port of said pressure boosting jet pump 406 for controlling the flow and the pressure of the refrigerant entering said pressure boosting jet pump;

wherein during operation under high temperature range, the intake pressure of said compressor 401 is sufficient to operate without any pressure boosting, therefore, said control valve 405 is closed and said pressure boosting jet pump has no effect on the intake pressure of said compressor 401;

wherein during operation under median temperature range and low temperature range, the intake pressure of said compressor 401 is decreased and insufficient for operation, therefore, said control valve 405 is open to activate said pressure boosting jet pump 406, then said pressure boosting jet pump 406 intakes the gaseous refrigerant from the high pressure side pipe to increase the intake pressure of said compressor 401, thus said compressor 401 can keep operating at optimum load under different temperature ranges.

6. An wide-range air condition heat pump, as defined in claim 5, further comprises at least one additional set of a pressure boosting jet pump and a control valve connecting to the high pressure pipe for additional intake pressure boost of said compressor 401.

7. An wide-range air condition heat pump, as defined in claim 5, wherein said control valve 405 and the high pressure intake port of said pressure boosting jet pump 406 are connected to the high pressure side pipe within said condenser 402.

8. An air condition heat pump, as defined in claim 2, further comprising:

a) at least an additional evaporator and a solenoid valve for stopping the flow of said additional evaporator;

b) at least an additional defrost condenser and a solenoid valve associated with said additional defrost condenser and heat transferring means for the defrosting process of said additional evaporator;

wherein during the defrosting process, only one of the three evaporators stop operating, the other two evaporators continue operating to provide the energy required for the defrosting process.

9. An air condition heat pump, as defined in claim 2, further comprises a pressure boosting jet pump and a control valve associated with said pressure boosting jet pump as described in claim 5 for operating under different temperature ranges.

10. An wide-range air condition heat pump, as defined in claim 5, wherein said pressure boosting jet pump can be replaced with a turbo or a rotary pump.

11. An air-condition heat pump with secondary compressor comprising:

a) one compressor 201 for pumping the refrigerant into a main condenser 202;

b) a heat exchanger 215 connecting its primary input to the output of said main condenser 202, the primary output of said heat exchanger is connected to the input of an expansion valve 203;

c) at least two evaporators 206 207 connecting with the output of said expansion valve 203;

d) one solenoid valve 204 associated with said evaporator 206 for stopping the flow of the refrigerant during defrosting process;

e) one solenoid valve 205 associated with said evaporator 207 for stopping the flow of the refrigerant during defrosting process;

f) a secondary compressor 214 for defrosting operation;

g) one defrost condenser 209 connecting to the discharge port of said secondary compressor 214;

h) one solenoid valve 208 for admitting the refrigerant flow into said defrost condenser 209 during the defrosting process of said evaporator 206;

i) one defrost condenser 211 connecting to the discharge port of said secondary compressor 214;

j) one solenoid valve 210 for allowing the refrigerant flow into said defrost condenser 211 during the defrosting process of said evaporator 207;

k) heat transferring means for said two defrost condenser 209 211 transferring the heat onto said two evaporator 206 207 during defrosting process;

l) an expansion valve 216 connecting its input to said defrost condenser 209 and defrost condenser 211, the output of said expansion valve 216 is connected to the secondary input of said heat exchanger 215, and the secondary output of said heat exchanger is connected to the suction of port of said secondary compressor 214;

wherein when the defrosting process is not necessary, said secondary compressor 214 is turned off, and both said solenoid valve 204 and solenoid valve 205 remain open;

wherein during the defrosting process of said evaporator 206, the air condition heat pump is capable of uninterrupted operation by turning off said evaporator 206 with said solenoid valve 204, said solenoid valve 208 is open and said evaporator 207 remains operating, the refrigerant that flows out the secondary output of said heat exchanger 215 absorbs the heat of the refrigerant that flows in the primary input in order to evaporate the refrigerant into gaseous state before entering said secondary compressor 214, then said secondary compressor 214 starts operating to heat up said defrost condenser 209 and defrost said evaporator 206;

wherein during the defrosting process of said evaporator 207, the air condition heat pump is capable of uninterrupted operation by turning off said evaporator 207 with said solenoid valve 205, said solenoid valve 210 is open and said evaporator 206 remains operating, the refrigerant that flows out the secondary output of said heat exchanger 215 absorbs the heat of the refrigerant that flows in the primary input in order to evaporate the refrigerant into gaseous state before entering said secondary compressor 214, then said secondary compressor 214 starts operating to heat up said defrost condenser 211 and defrost said evaporator 207.

12. An air condition heat pump with secondary compressor, as defined in claim 11, further comprises a pressure boosting jet pump and a control valve associated with said pressure boosting jet pump as described in claim 5 for operating under different temperature ranges.

* * * * *